US011772859B2

(12) United States Patent
Parle

(10) Patent No.: US 11,772,859 B2
(45) Date of Patent: Oct. 3, 2023

(54) PACKAGING WITH AN AROMA DETECTION FEATURE

(71) Applicant: Darrin Parle, Novato, CA (US)

(72) Inventor: Darrin Parle, Novato, CA (US)

( * ) Notice: Subject to any disclaimer, the term of this patent is extended or adjusted under 35 U.S.C. 154(b) by 386 days.

(21) Appl. No.: 16/136,615

(22) Filed: Sep. 20, 2018

(65) Prior Publication Data

US 2019/0344935 A1 Nov. 14, 2019

Related U.S. Application Data

(60) Provisional application No. 62/762,572, filed on May 10, 2018.

(51) Int. Cl.
*B65D 47/20* (2006.01)
*B65D 51/20* (2006.01)

(52) U.S. Cl.
CPC ..... *B65D 47/2006* (2013.01); *B65D 51/20* (2013.01); *B65D 2205/02* (2013.01); *B65D 2251/0028* (2013.01)

(58) Field of Classification Search
CPC ..... B65D 47/2006; B65D 51/20; B65D 2205/02; B65D 2251/0028
See application file for complete search history.

(56) References Cited

U.S. PATENT DOCUMENTS 2,890,810 A * 6/1959 Rohling ..... B65D 51/1644 220/231
3,672,114 A * 6/1972 Sacks ..... F04B 45/02 53/88
2016/0318672 A1* 11/2016 Smith ..... B65D 51/24
2017/0190482 A1* 7/2017 Smith ..... B65D 51/1672

* cited by examiner

*Primary Examiner* — Shawn M Braden
(74) *Attorney, Agent, or Firm* — Savantek Patent Services; Ivan E. Rozek

(57) ABSTRACT

A package with an aroma detection feature. The package is an air tight container that includes a primary passageway container aperture and a secondary container aperture. The primary container aperture is a standard closure device for allowing a person to have access to the material stored within the container. The secondary aperture includes an air tight closure that can be opened by a user to have access to the aroma of the material contained within the container and then closed again in an air tight manner. The secondary container aperture includes a push button that when pushed by a user allows access to the aroma of the material contained in the container and when the button is released the secondary aperture returns to an air tight closed position.

4 Claims, 28 Drawing Sheets

PACKAGING WITH AN AROMA DETECTION FEATURE

CROSS REFERENCE TO RELATED APPLICATIONS

U.S. Provisional Patent Application No. 62/762,572 filed May 10, 2018, the entire specification of which is herein incorporated by reference.

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of packaging containers and more specifically to a packaging container with the ability for the user to have temporary aroma detection of the contents of the package without needing to open the primary closure of the package.

Packaging containers such as bottles and pouches have been in use for many years to contain all manner of items including food items and items such as cannabis.

Items such as cannabis are required to be packaged in a manner that includes a child proof closure. Other closures for bottles and pouches include a tamper proof indicator that shows if the bottle or pouch has been opened previous to purchase. In the case of cannabis, a potential purchaser may want to check the scent or aroma of the material before purchase, however, to do so would require that the purchaser open the tamper proof closure thereby potentially contaminating the contents of the package.

Therefore, it would be advantageous to provide a method for checking the aroma of the contents of a package without opening the primary closure components of the package.

BRIEF SUMMARY OF THE INVENTION

The primary object of the invention is to provide the ability to detect the aroma of the contents of an airtight sealed container without opening the primary container content passageway.

Another object of the invention is to provide an aroma detection access for a container that can be opened and then closed again in an airtight manner.

Another object of the invention is to provide an aroma detection access for a container that inhibits the introduction of extraneous liquids or particles into the container.

A further object of the invention is to provide an aroma detection access for a container where the aperture for detecting the aroma is automatically closed after each use.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a packaging device with aroma detection capability comprising: an airtight container, a container passageway aperture, the passageway being a neck of a botte when the container is a bottle, a secondary container aperture, said primary container passageway aperture including a standard closure device for allowing a person to have access to the material stored within said container, and said secondary aperture including an air tight closure that can be opened by a user to have temporary access to the aroma of the said material contained within said container and then closed again in an airtight manner.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE DRAWINGS AND PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
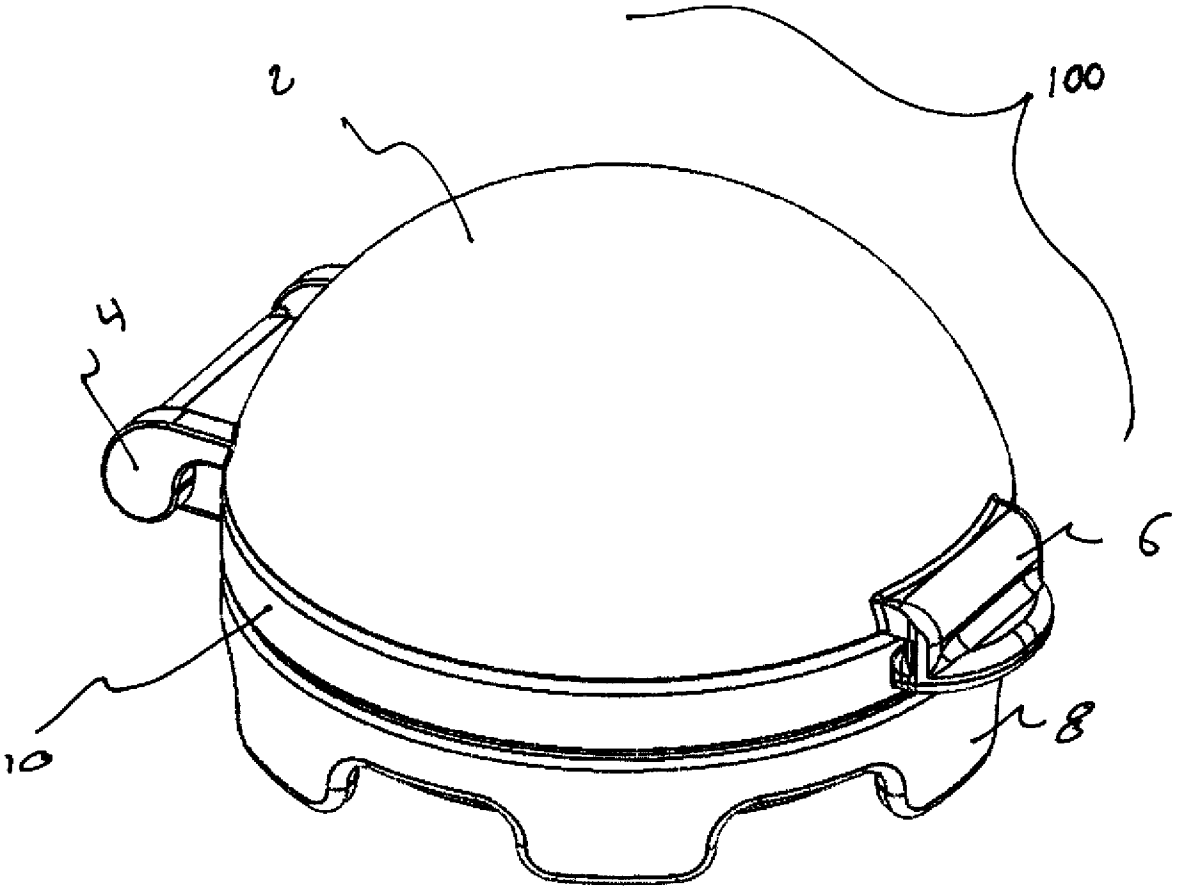
FIG. 1 is a perspective view of the button version embodiment with the lid closed.

Referring now to FIG. 1 we see a perspective view of the embodiment 100. A rigid protective cap 2 is hinged 4 to top plate 10. The user can lift the cap by pulling up on tab 6. The lower plate 8 helps trap a layer of a pouch 16 to the top plate 10.

Figure 2:
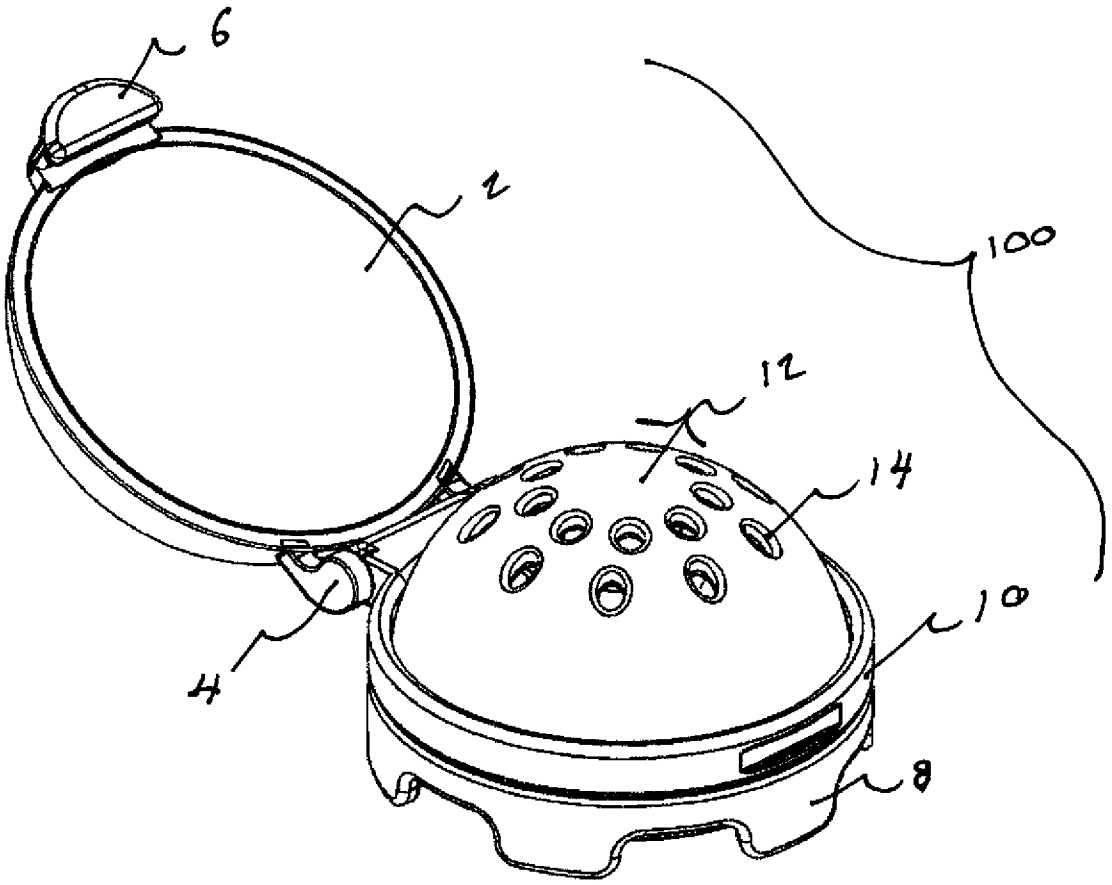
FIG. 2 is a perspective view of the button version embodiment with the lid open.
Figure 4:
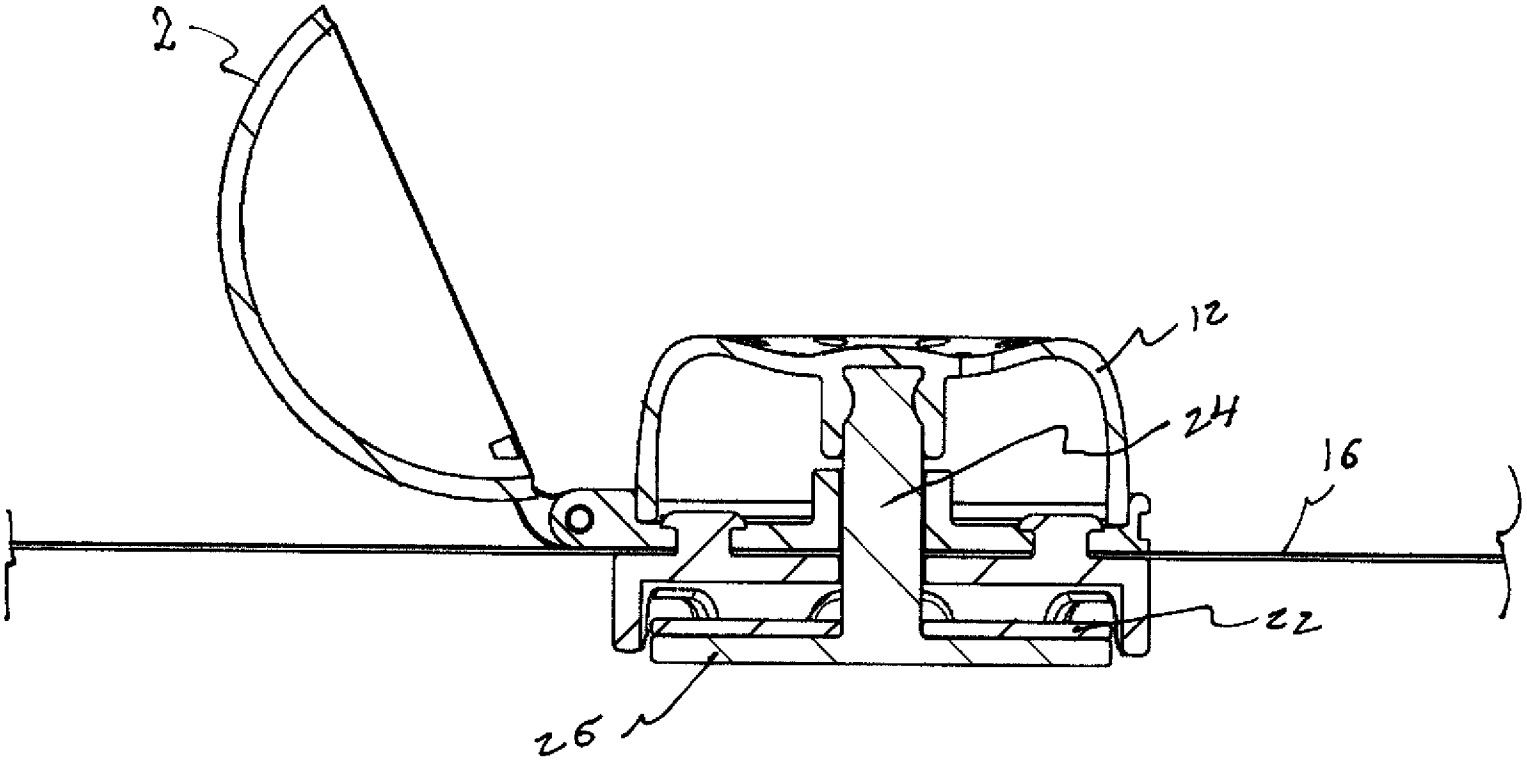
FIG. 4 is a side section view of the button version in the pushed position.

FIG. 2 is a perspective view of the embodiment 100 with the cap 2 raised exposing resilient dome shaped push button 12. The button 12 includes a plurality of apertures 14 that allow a scent to be smelled coming from the interior of the pouch 16 as shown in FIG. 4. The apertures 14 are small enough so as to minimize the chance of extraneous liquid or particles from entering the underside of the button 12. This embodiment of the invention [[100]] allows a user, when the button 12 is pressed, to smell the contents of a pouch without needing to tear open the tamper proof seal found on many pouches so that the integrity and purity of the contents of the pouch remains intact. We also discovered that pressing the button multiple times helps displace air from within the pouch to the outer atmosphere, thereby increasing the ability to smell the aroma of the cannabis product within the pouch.

Figure 3:
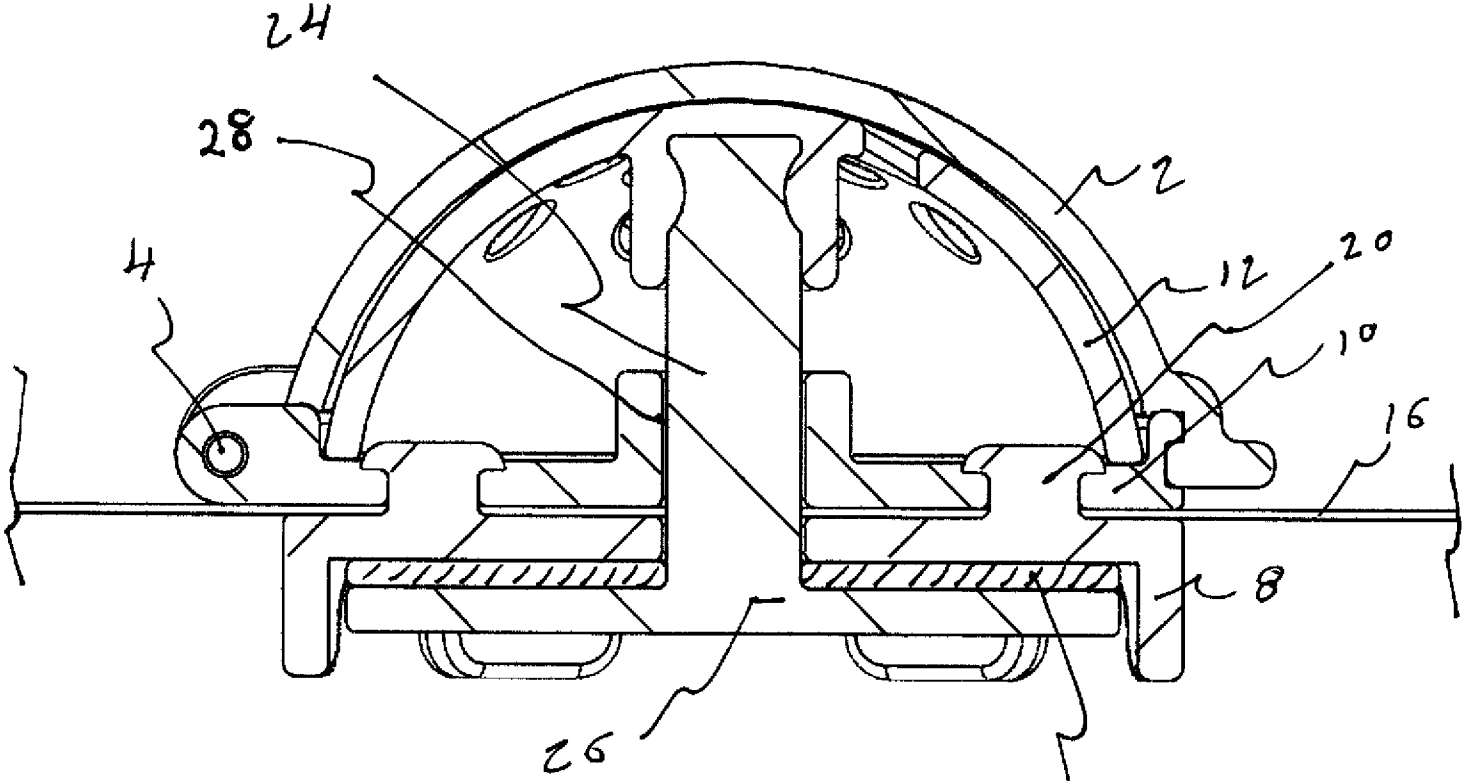
FIG. 3 is a side section view of the button version in the un-pushed position.

FIG. 3 is a side section view of the embodiment showing a shaft member 24 extending down from the underside of the dome shaped button 12 and terminating in disc 26. Flat gasket 22 helps create an airtight seal between the disc 26 and the aperture 28 that slidably engages the shaft 24. Posts 20 penetrate apertures in the pouch material 16 through apertures 18 and in top plate 10 and are ultrasonically welded to form heads which lock the assembly together.

FIG. 4 is a side section view of the embodiment with the rigid protective cap 2 in the open position and with the resilient button 12 in the pressed position causing attached shaft 24 to lower. The disc 26 is also caused to lower thereby allowing scented air from the inside of the pouch 16 to migrate out through the apertures of dome shaped button 12. This allows a person to sample the scent of the interior contents of an otherwise sealed pouch 16 without opening the passageway access of the pouch.

Figure 5:
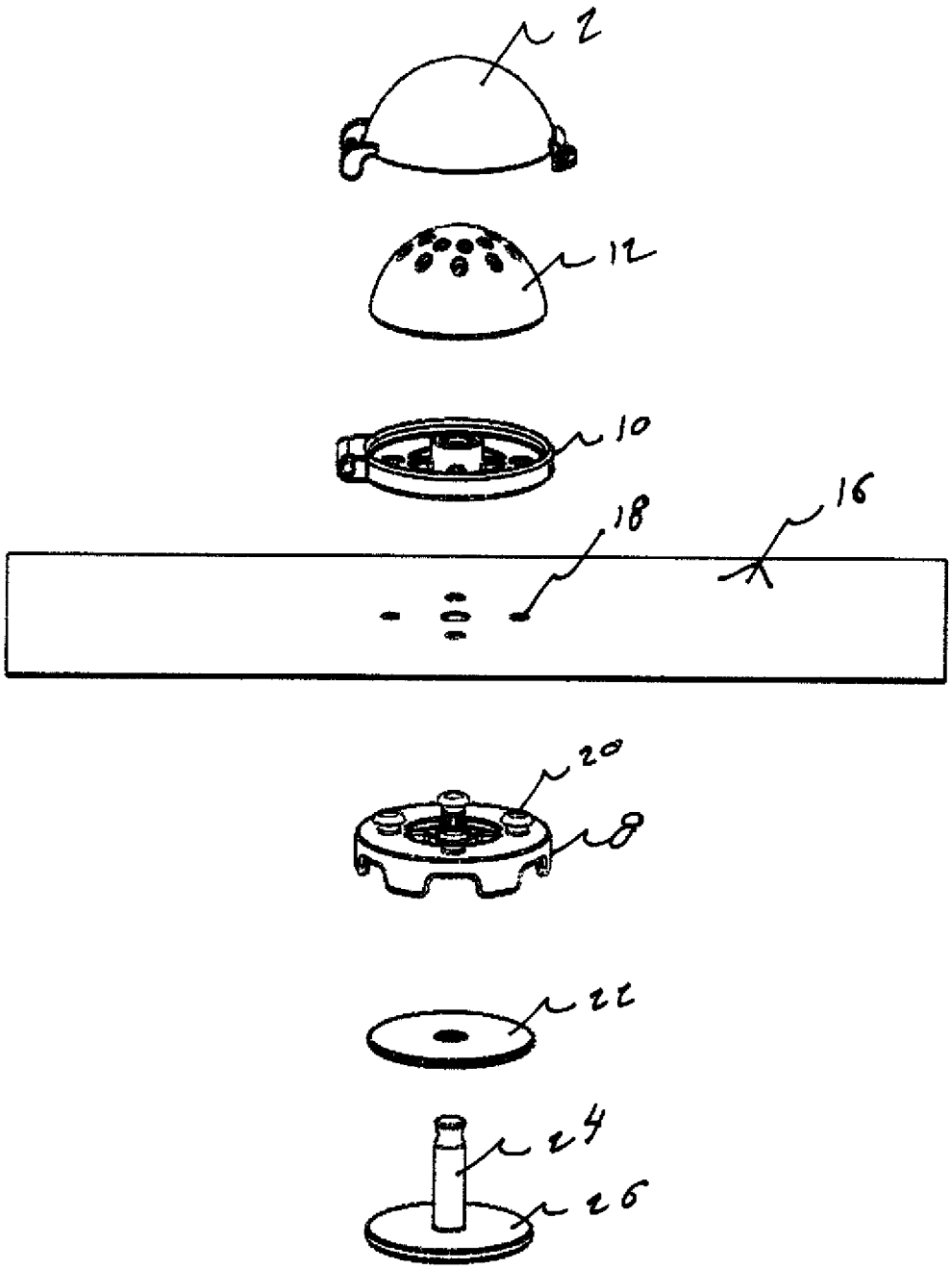
FIG. 5 is an exploded view of the button version embodiment mounted to a pouch type container.

FIG. 5 is an exploded view of the invention and shows all components before they are joined together as shown in FIGS. 1 through 4.

Figure 6:
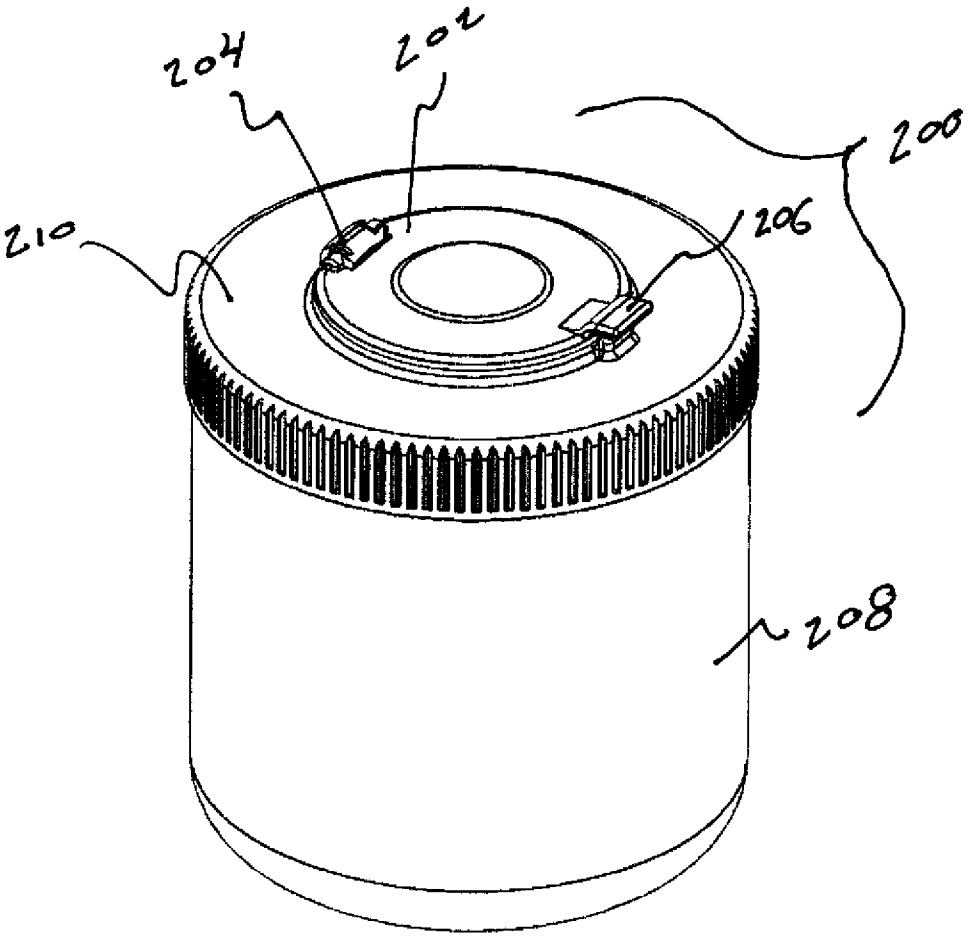
FIG. 6 is a perspective view of the button version embodiment in the closed position mounted to the cap of a bottle.
Figure 7:
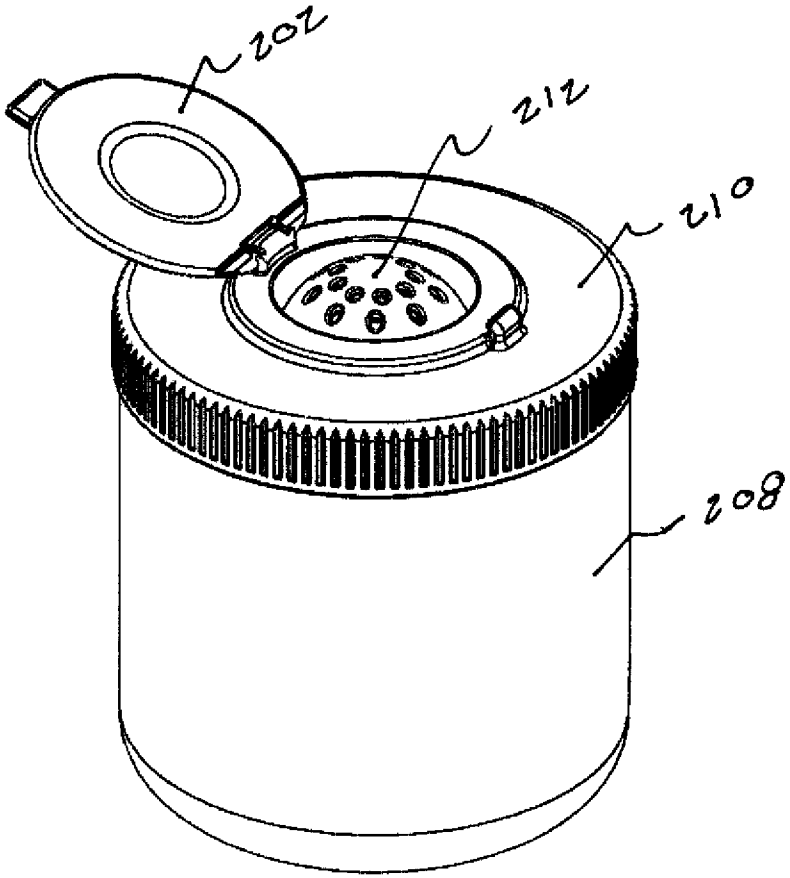
FIG. 7 is a perspective view of the button version embodiment in the open position mounted to the cap of a bottle.

FIG. 6 is a perspective view of embodiment 200, a similar embodiment as shown in FIGS. 1 through 5 except that it is attached to the cap 210 of a bottle 208. Protective cover 202 prevents accidental activation of the resilient button 212 as shown in FIG. 7. In this embodiment 200 the invention has been set down into the cap 210 so that the top cap 202 is relatively flush with the top of the bottle cap 210. As in the pouch version, it was found that pushing the button 212 multiple times helps displace air from within the bottle to the air immediately outside the bottle.

Figure 8:
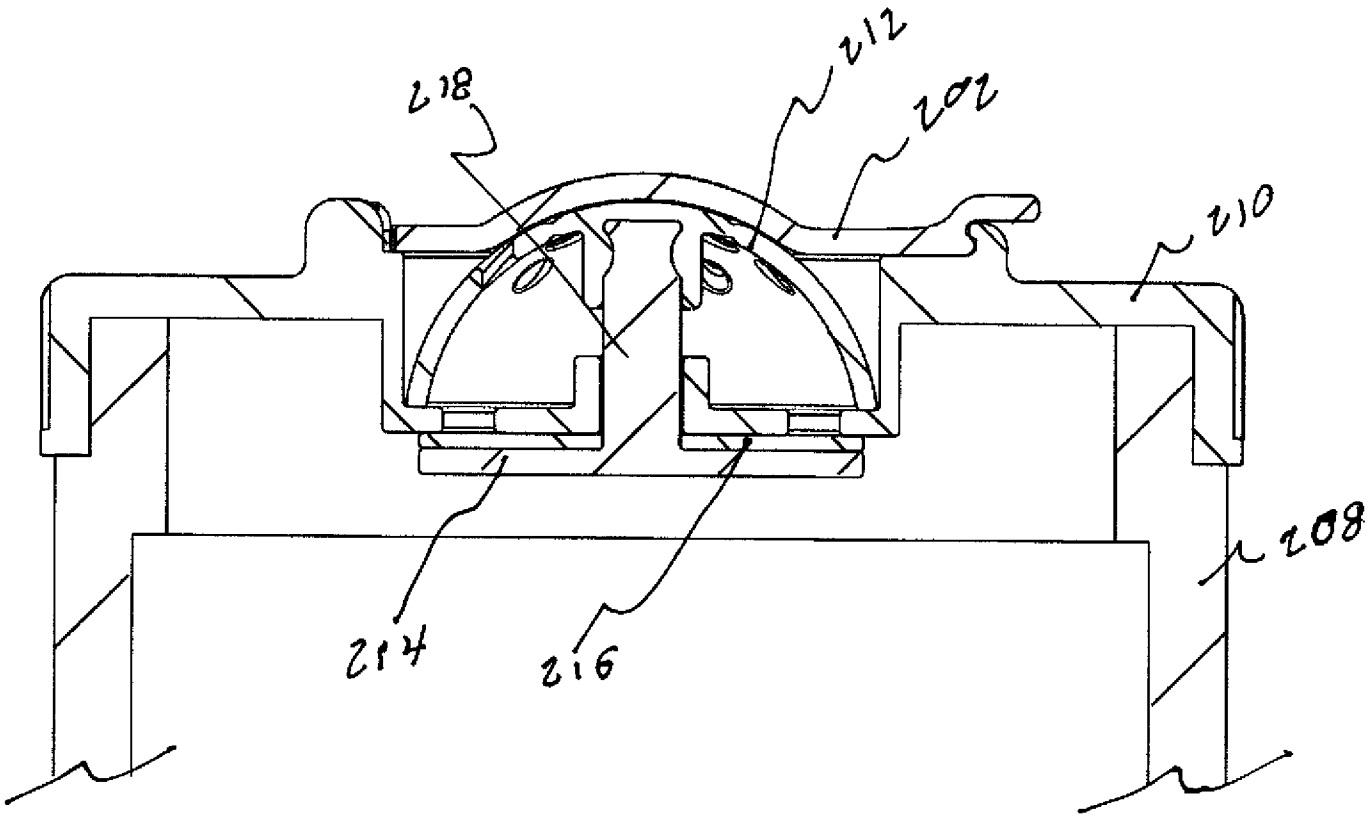
FIG. 8 is a side section view of the cap bottle version in the closed position.

FIG. 8 is a side section of the bottle version of the embodiment 200. The mechanical operation is the same as the pouch version 100 where disc 214 and gasket 216 can be pushed down via shaft 218 to allow scented air to migrate through the apertures in resilient button 212.

Figure 9:
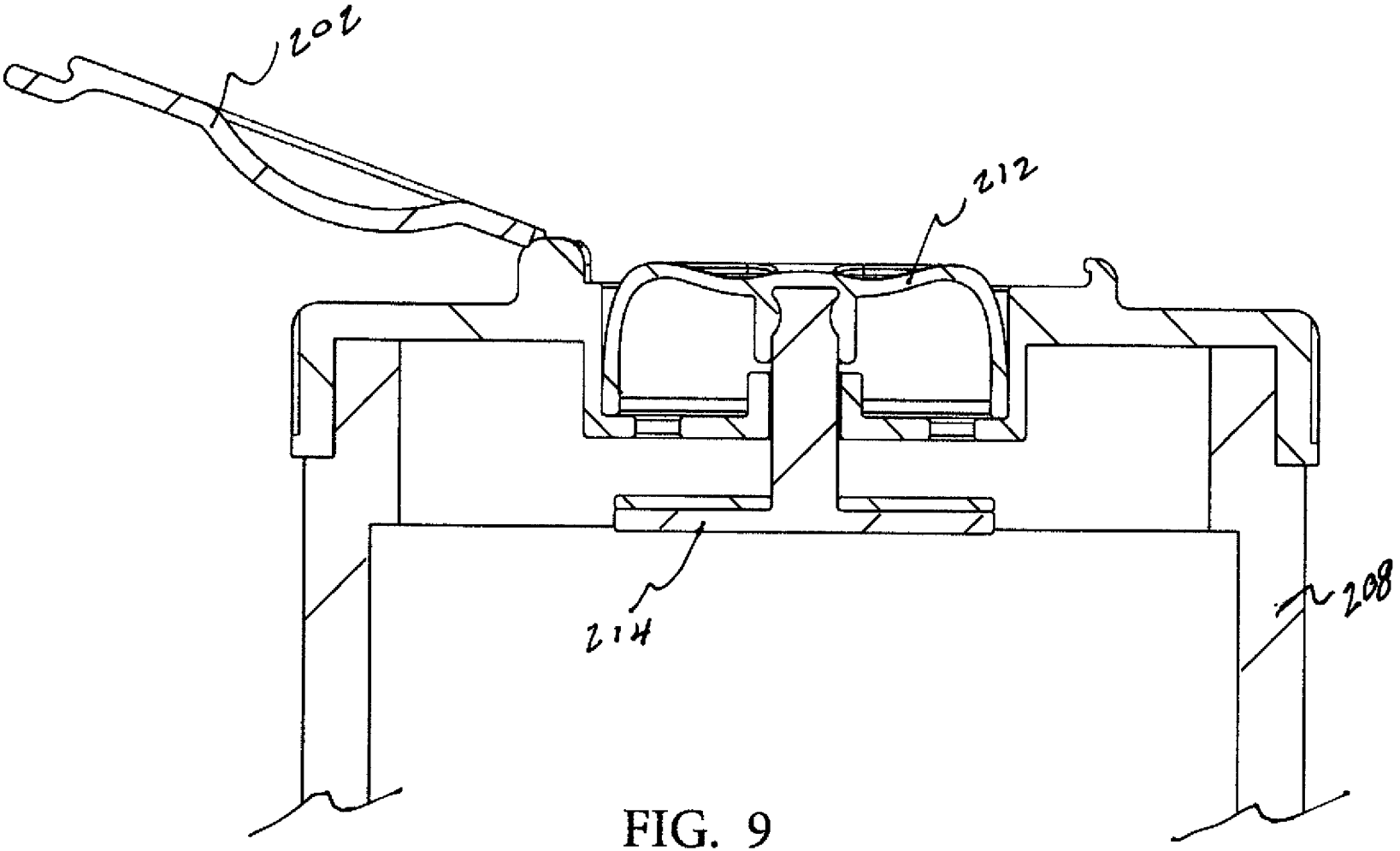
FIG. 9 is a side section view of the cap bottle version in the open position.

FIG. 9 is a side section view of the bottle version of the embodiment 200 showing the button 212 pressed and the disc 214 pushed down so that scented air may temporarily escape from the interior of bottle 208 until the button 212 is released by the user.

Figure 10:
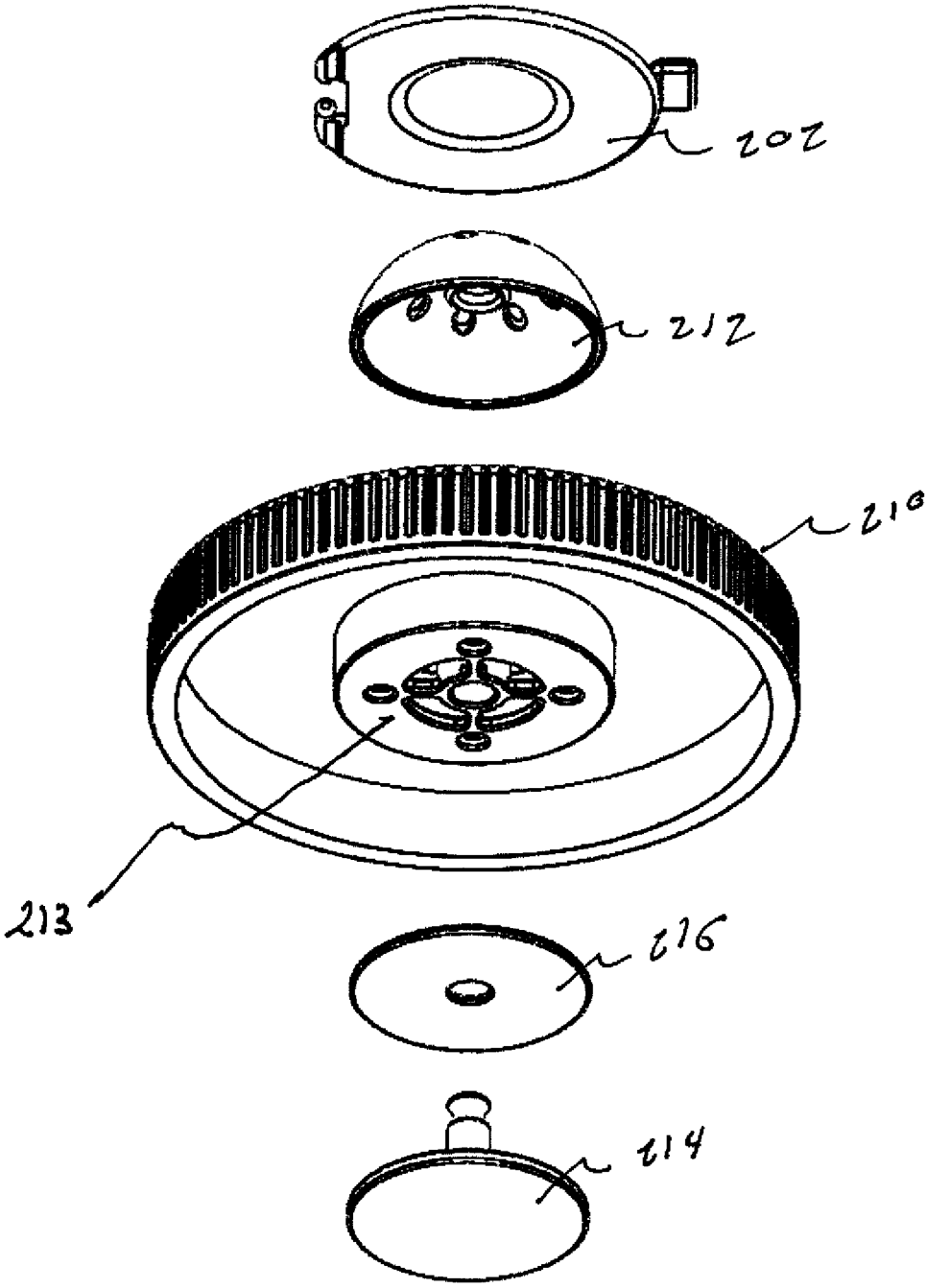
FIG. 10 is an exploded view of the cap bottle version.
Figure 11:
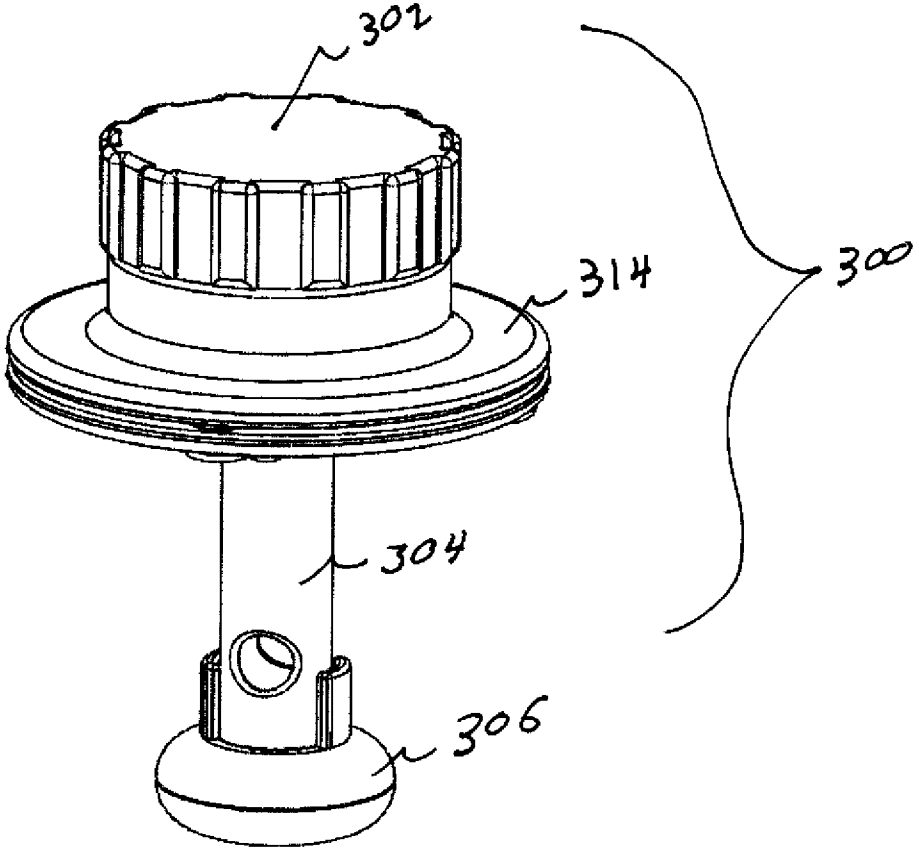
FIG. 11 is a perspective view of a second version of the button embodiment.
Figure 12:
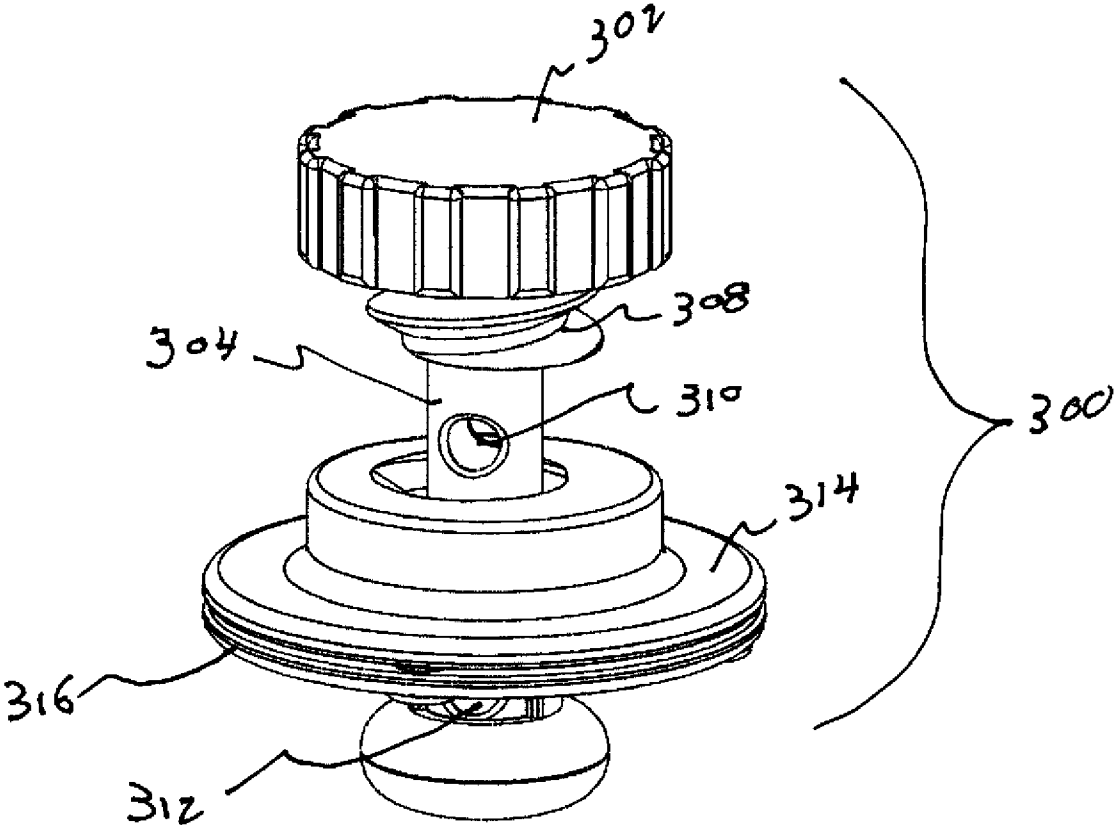
FIG. 12 is a perspective view of the second version of the button version in the open position.
Figure 13:
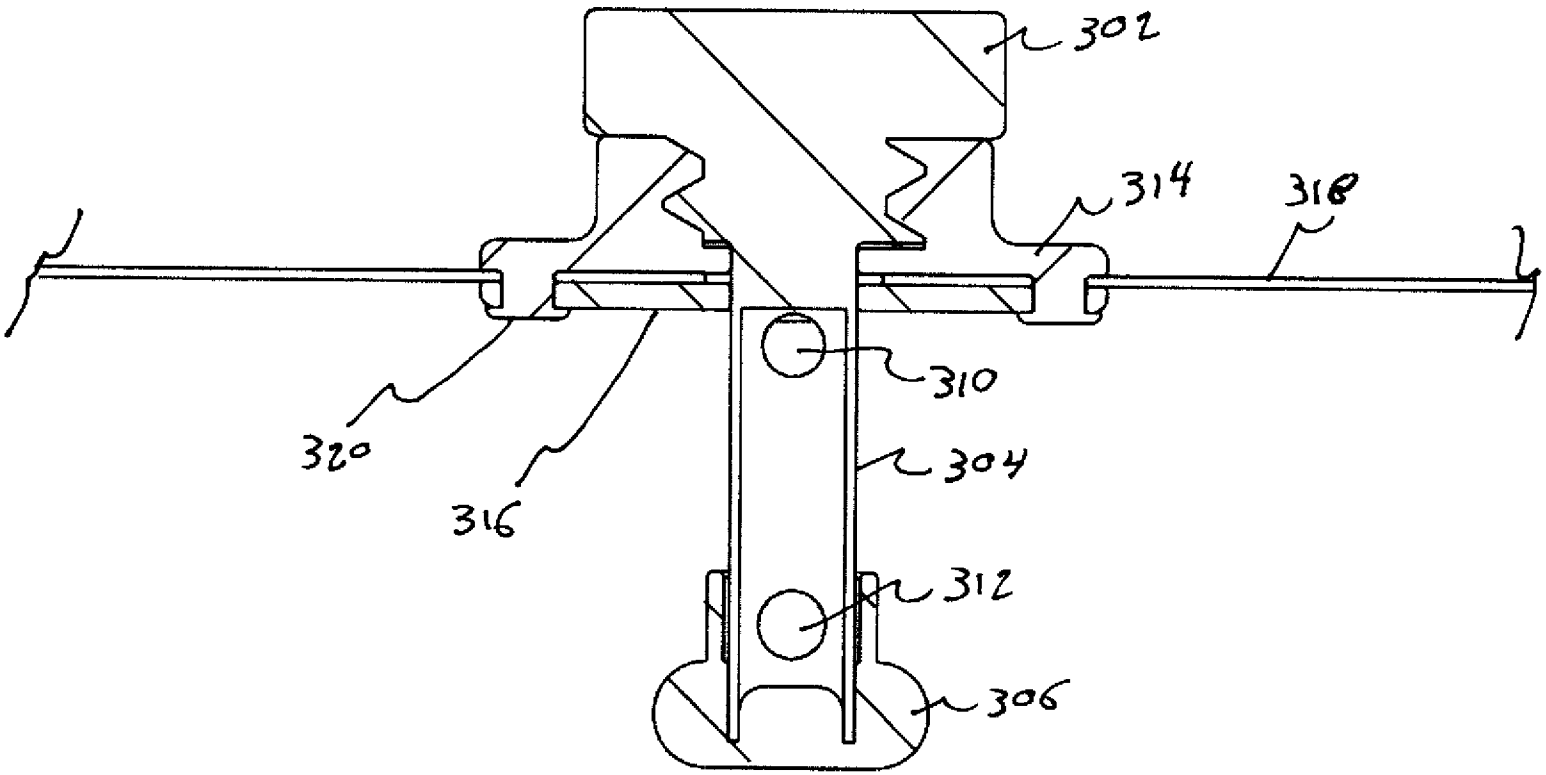
FIG. 13 is a side section view of the second version of the button version in the closed position.
Figure 14:
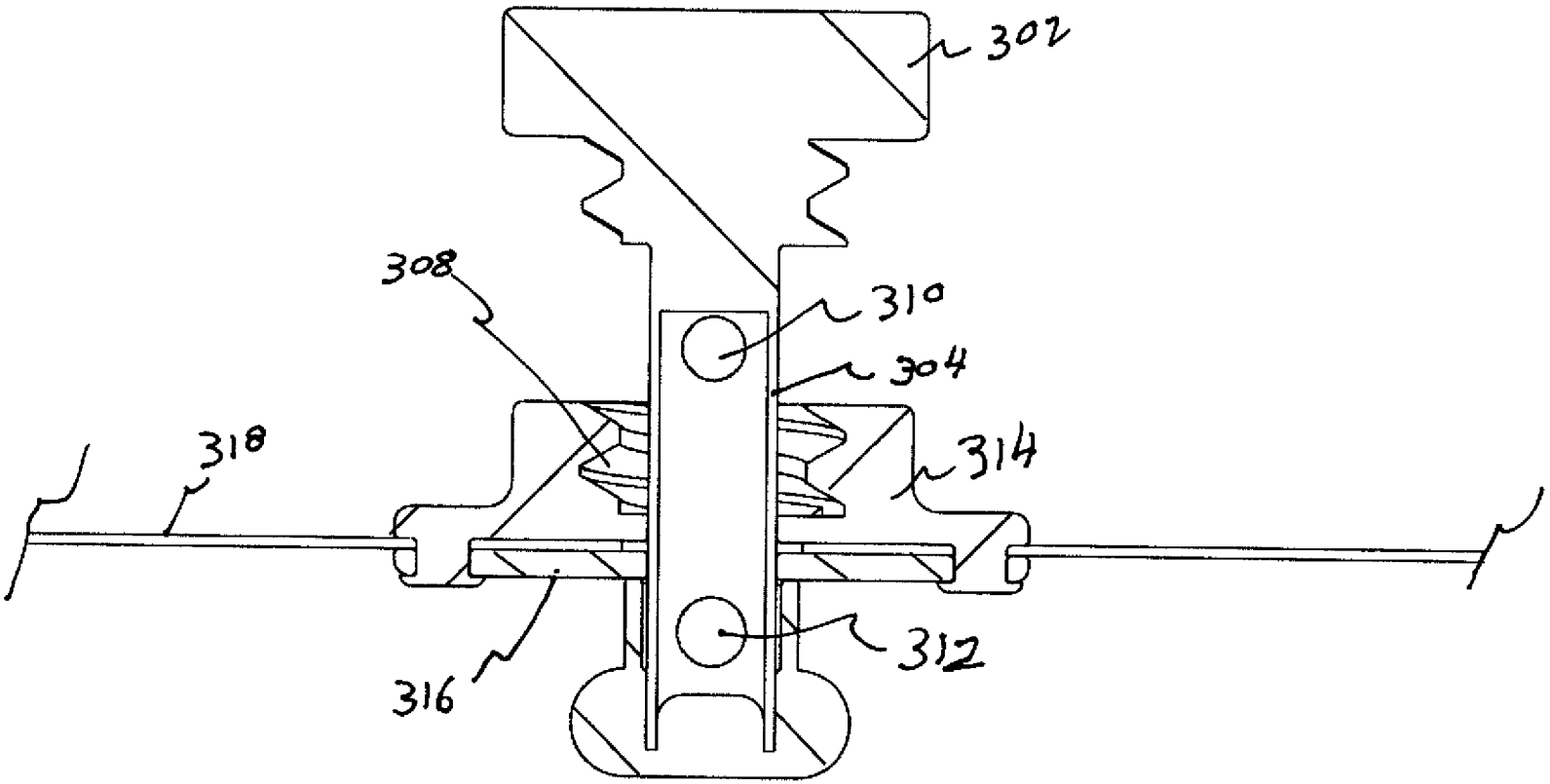
FIG. 14 is a side section view of the second version of the button version in the open position.
Figure 15:
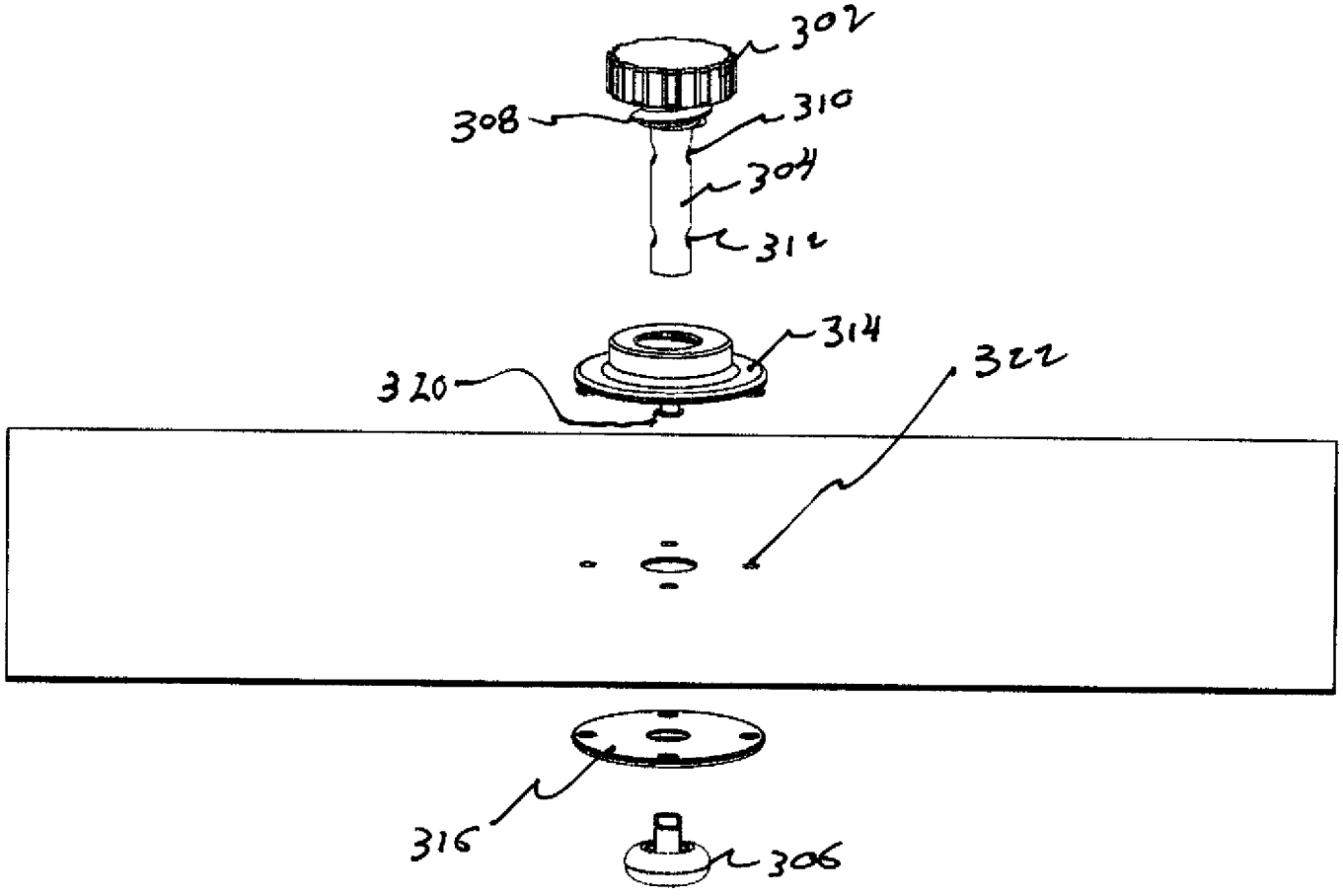
FIG. 15 is an exploded view of the second version of the button embodiment.

FIG. 10 Is an exploded view of the bottle version of the embodiment 200 clearly showing the components used and the recessed portion 213 of cap 210 which allows for the relatively flush condition of protective cap 202 in relation to the top surface of bottle cap 210.

FIGS. 11 through 20 illustrates a second version of the invention 300, 400 which produces a similar result to the first versions 100, 200 except that a knob 302 can be rotated counter-clockwise to unscrew threads 308 on hollow shaft 304 from top cover 314 to allow scented air to travel through aperture 312 from the inside of a pouch 318 through aperture 310 located on the outside of the pouch 318 or bottle 406 so that a person may smell the contents of the inside of the pouch 318 or bottle 406. The user can then screw the top assembly 302, 304 back into top cover 314 to re-seal the assembly 300, 400. Lower member 306 prevents the user from pulling shaft 304 completely out of top cover 314. Gasket disc 316 is ultrasonically welded via posts 320 to lock the disc 316 to the underside of top cover 314 in an airtight manner.

Figure 16:
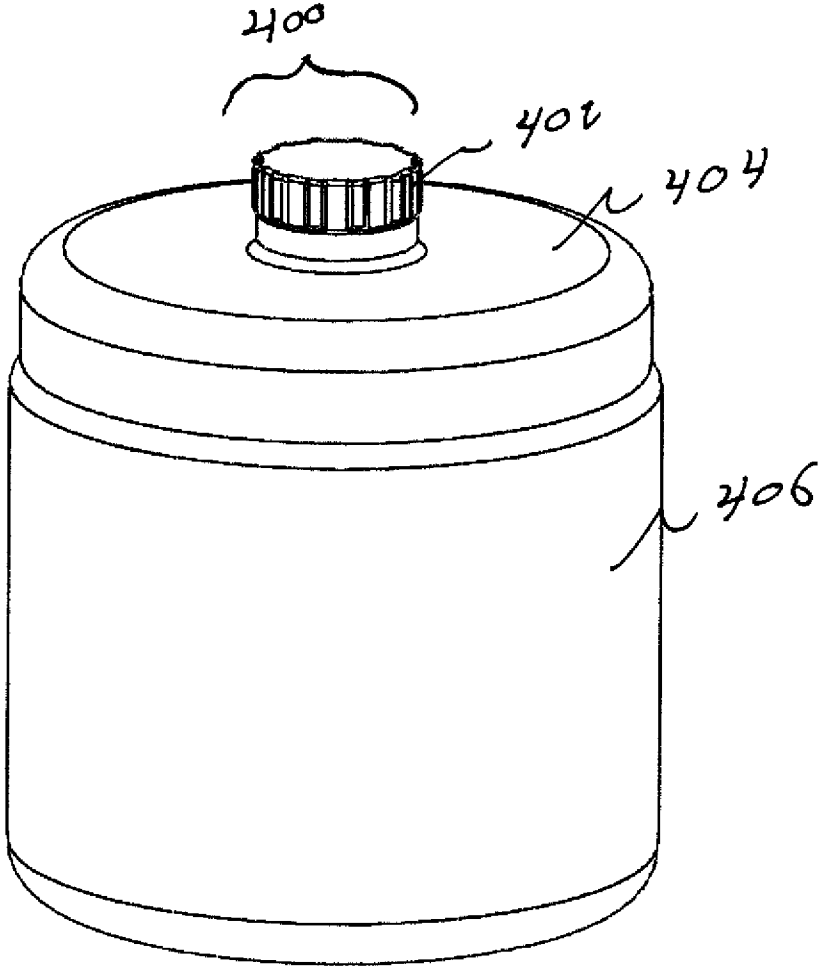
FIG. 16 is a perspective view of the second version of the button version of the invention mounted to the cap of a bottle.
Figure 17:
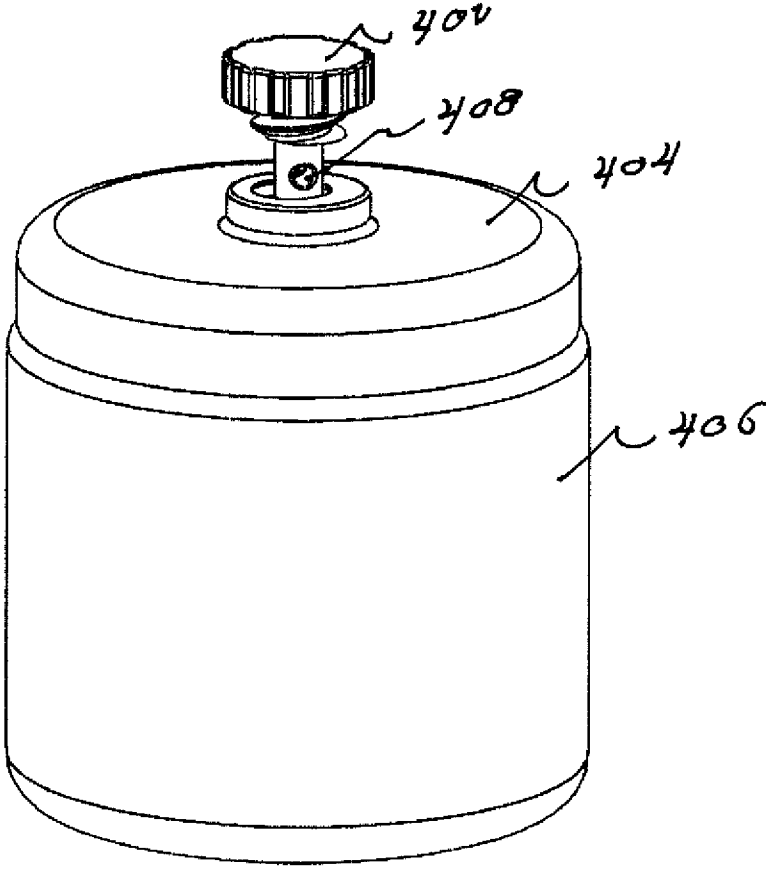
FIG. 17 is a perspective view of the second version of the button embodiment in the open position.
Figure 18:
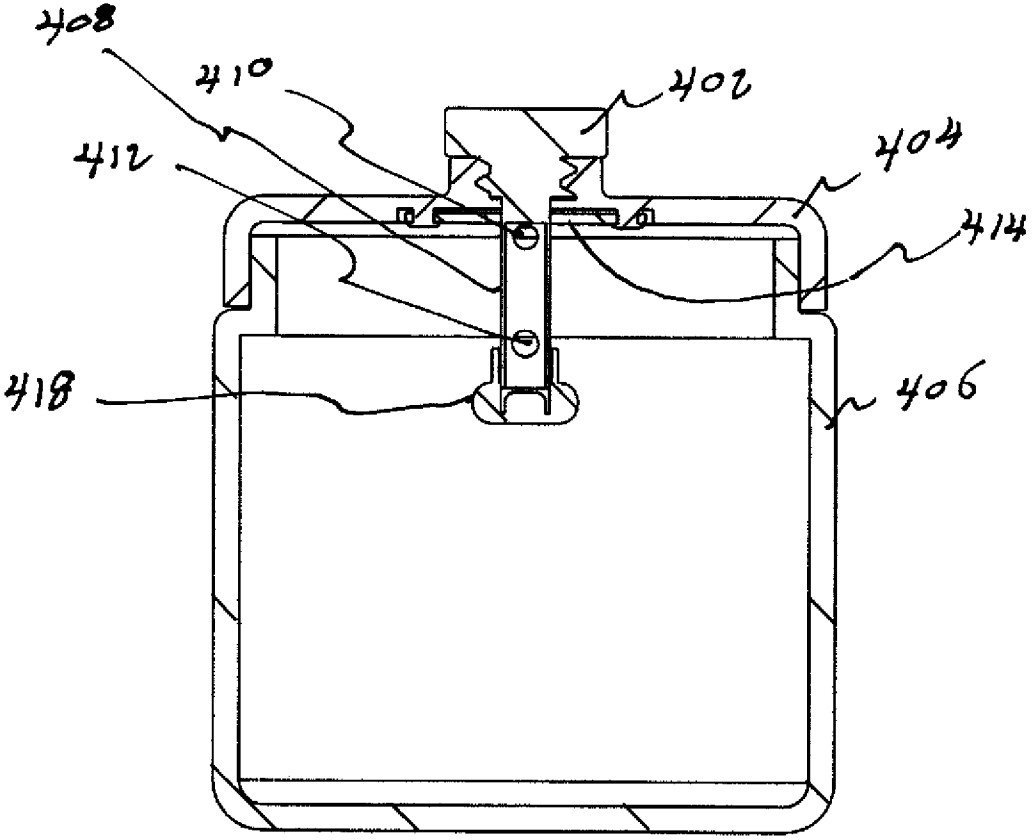
FIG. 18 is a side section view of the second version of the button embodiment.
Figure 19:
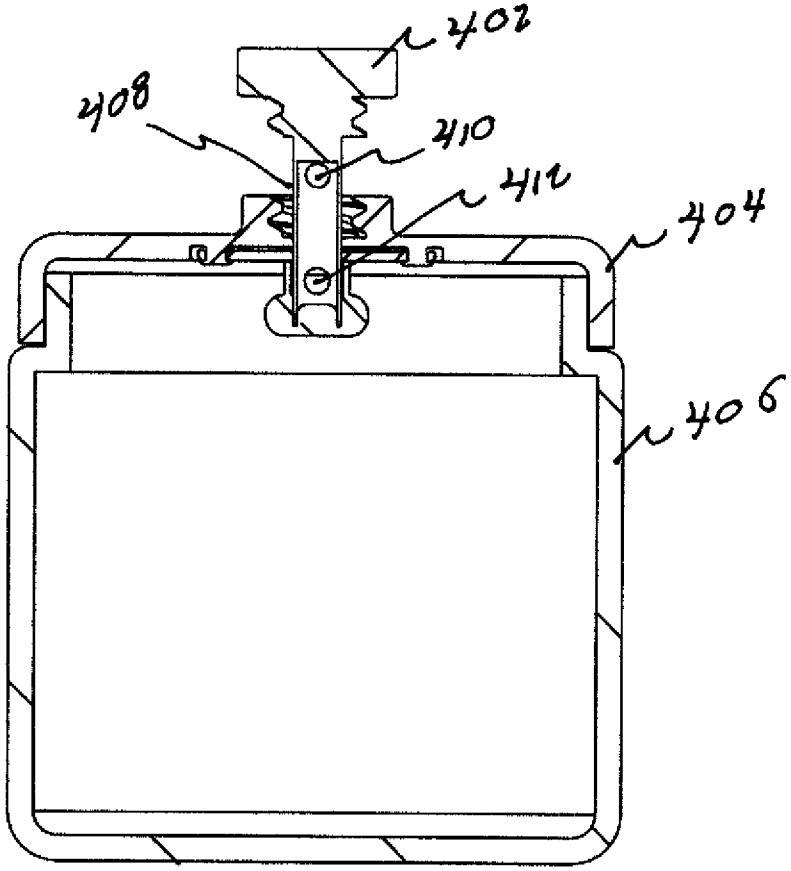
FIG. 19 is a side section view of the second version of the button embodiment in the open position.

FIG. 16 is a perspective view of the second version of the embodiment 400 in use on a bottle cap 404. The bottle cap 404 attaches to a bottle 406 in a standard manner. In some cases, the cap 404 is a tamper proof or child proof type cap that should not be opened unless by an adult after purchase. The invention 400 allows a person to smell the contents of the bottle 406 without opening the cap 404.

Figure 20:
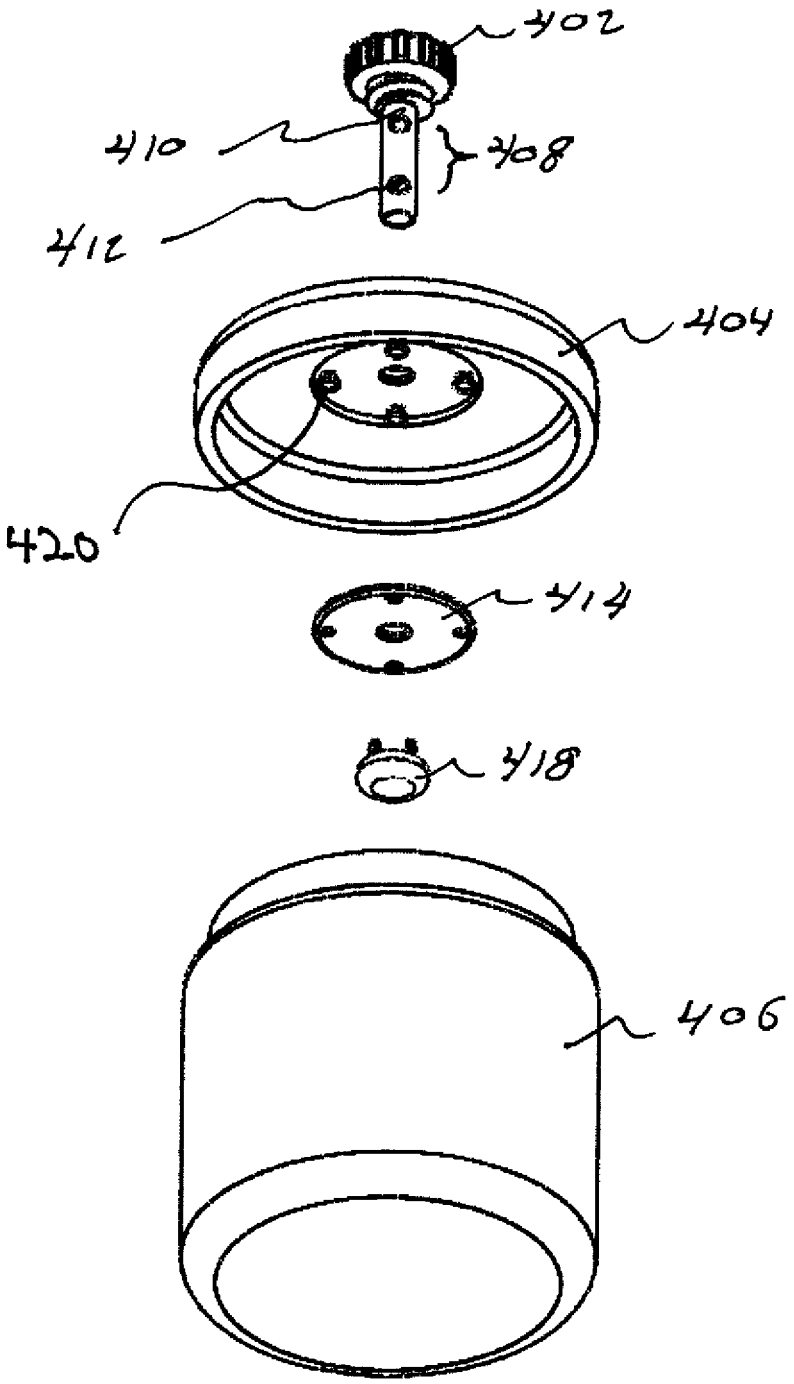
FIG. 20 is an exploded view of the second version of the button embodiment.
Figure 21:
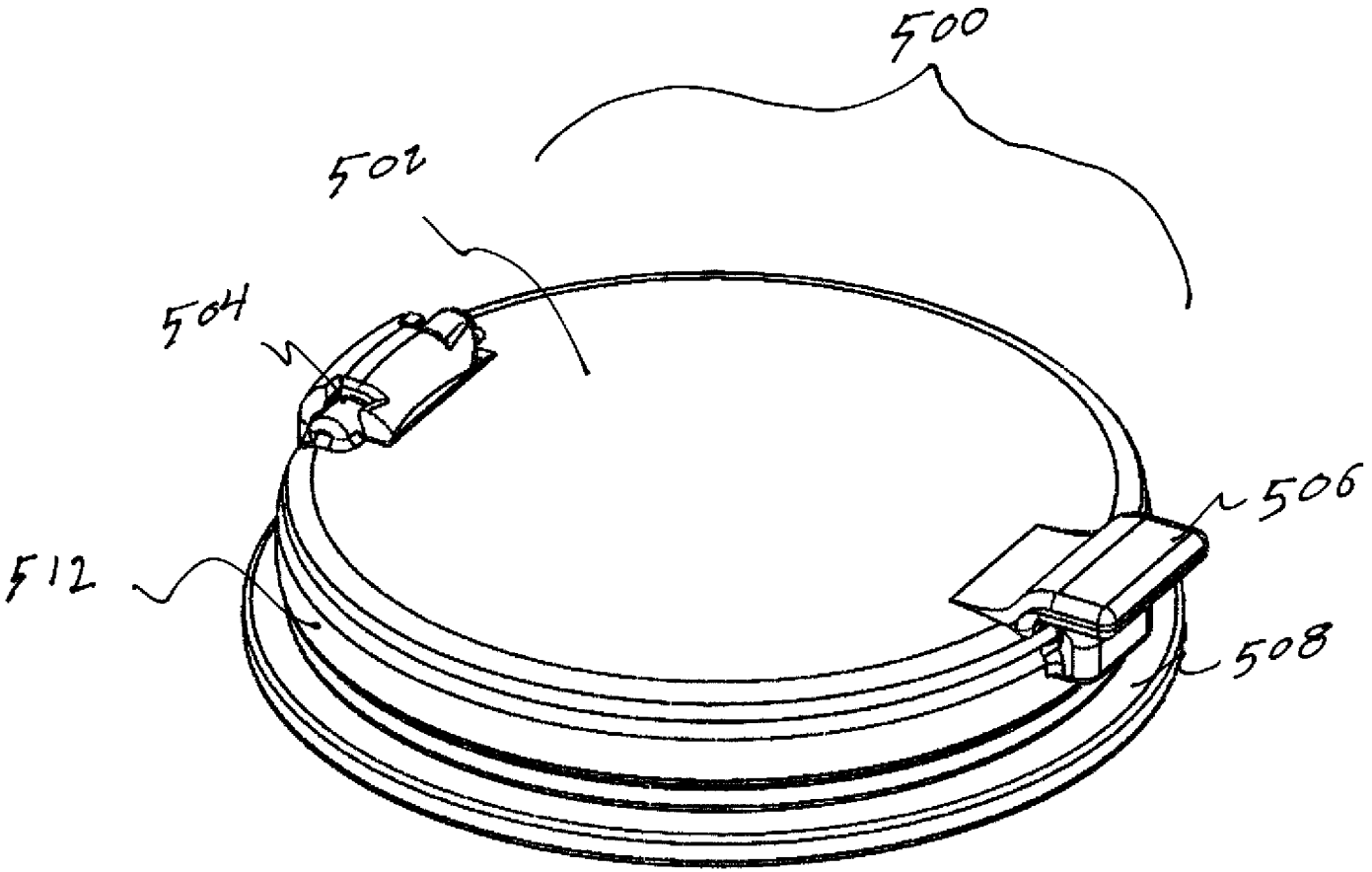
FIG. 21 is a perspective view of a second version of the embodiment.

FIGS. 17, 18, 19 and 20 show various views of the embodiment 400. Aperture 408 allows scented air to travel through hollow shaft 408 and out aperture 410 when the shaft 408 are lifted by the unscrewing of knob 402. bottom disc 414 is welded to top disc 404 via posts 420 as shown in FIG. 20. Lower member 418 attaches to the end of shaft 408 to prevent the shaft 408 from pulling completely out of top cover plate 404.

Figure 22:
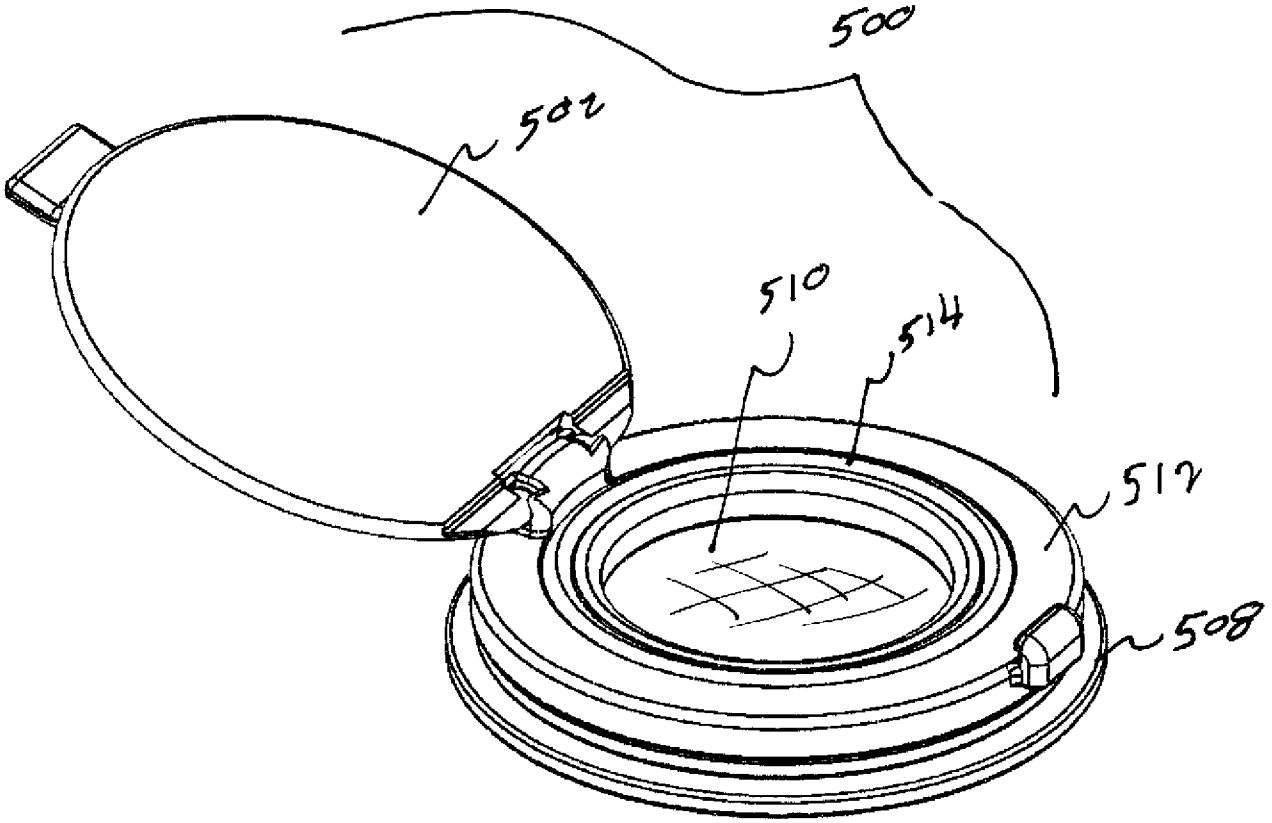
FIG. 22 is a perspective view of the second version of the embodiment in the open position.
Figure 23:
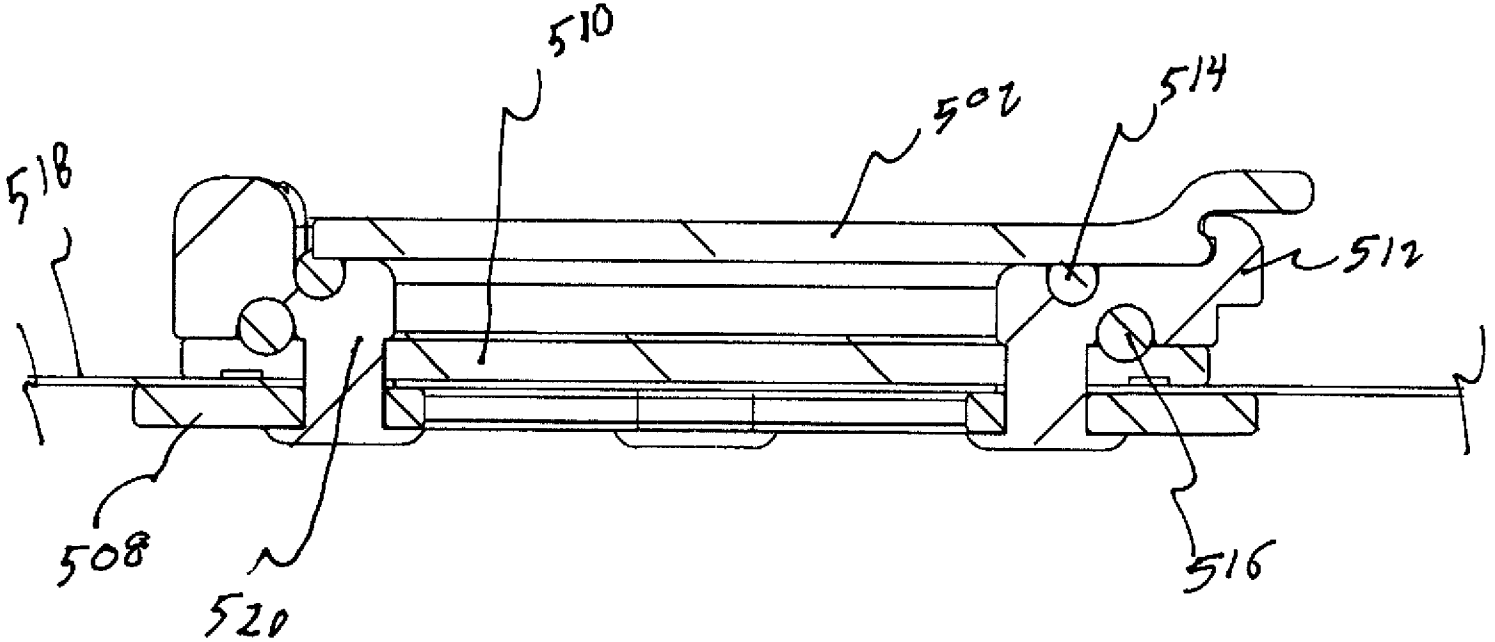
FIG. 23 is a side section view of the second version of the embodiment.
Figure 24:
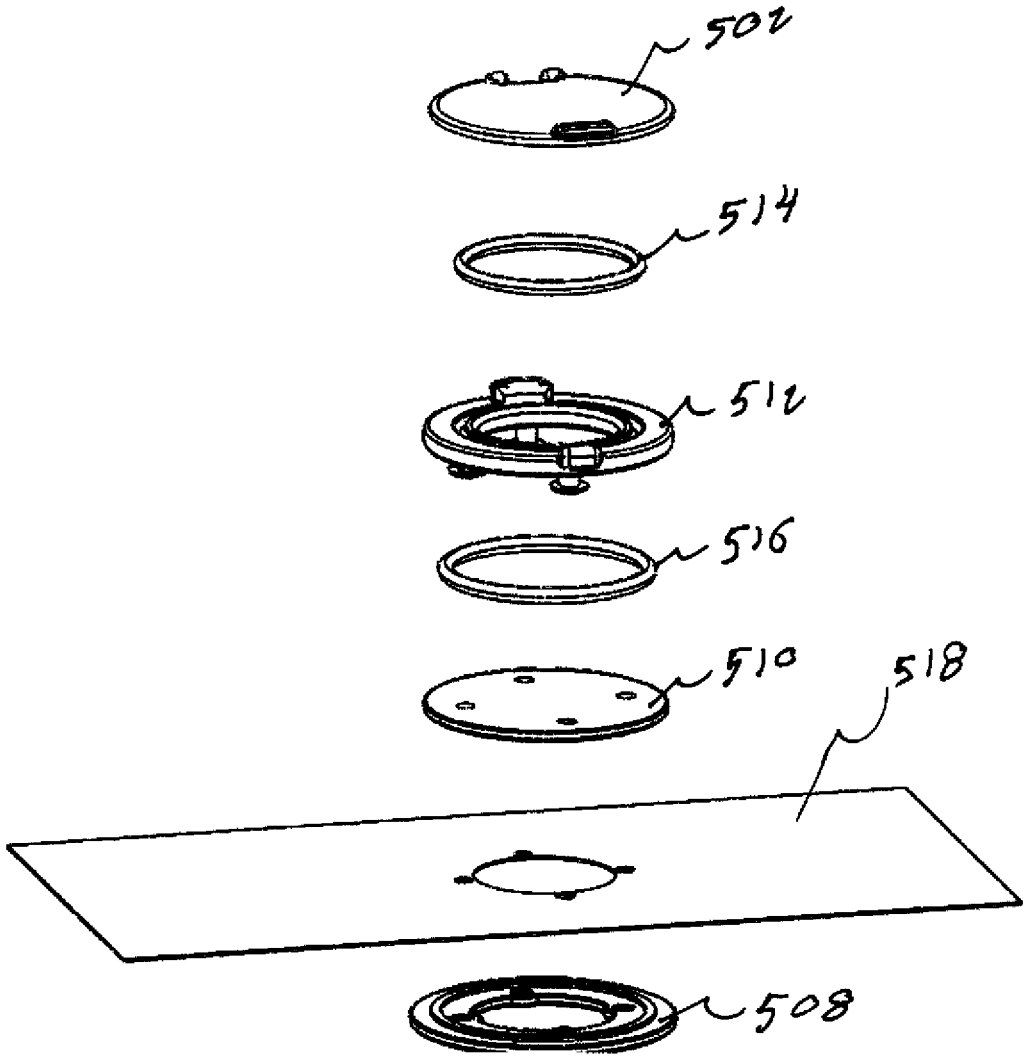
FIG. 24 is an exploded view of the second version of the embodiment mounted to a pouch.
Figure 25:
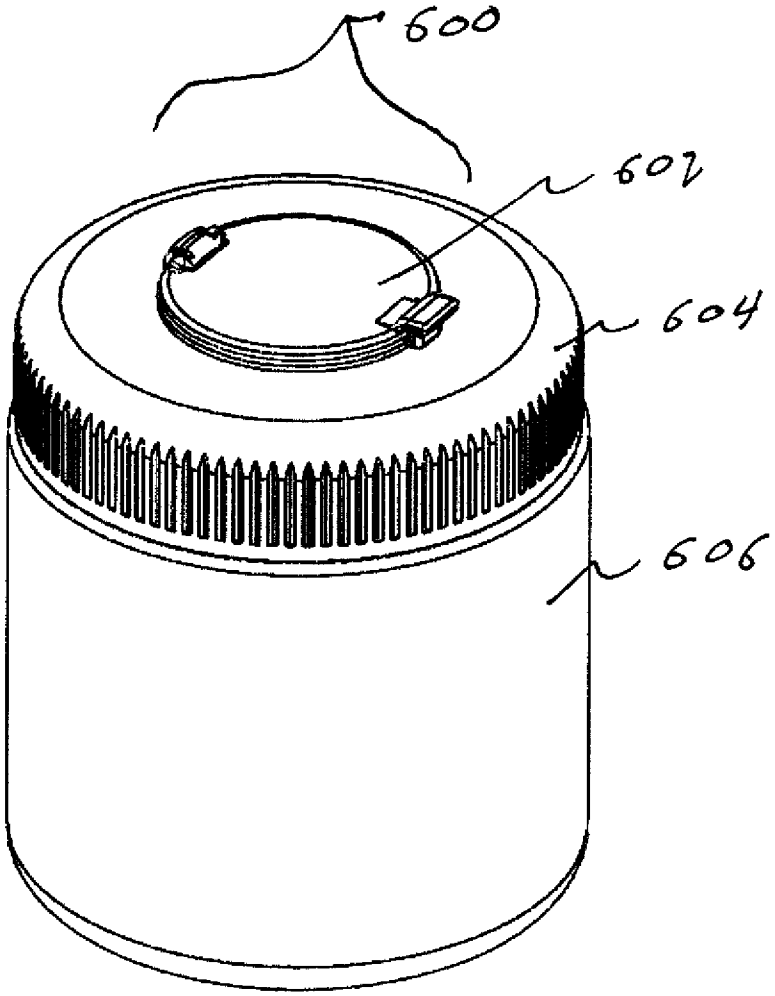
FIG. 25 is a perspective view of the second version of the embodiment mounted to the cap of a bottle.

FIGS. 21 through 24 illustrates a third version of the embodiment 500. In this version a filter disc 510 shown in FIG. 22 provides a barrier between the inside of a pouch 518 and the outside air. The filter allows air to pass through but is fine enough not to allow liquid to pass into or out of the pouch 518. One material called Porex which is a polyethylene foam can provide this effect, however other filter materials may be used.

A protective lid 502 is hinged 504 to top cover 512 and can be lifted by pulling up on tab 506. Lower disc 508 traps pouch sheet 518 to the top cover 512 via posts 520 as shown in the section view in FIG. 23.

Figure 26:
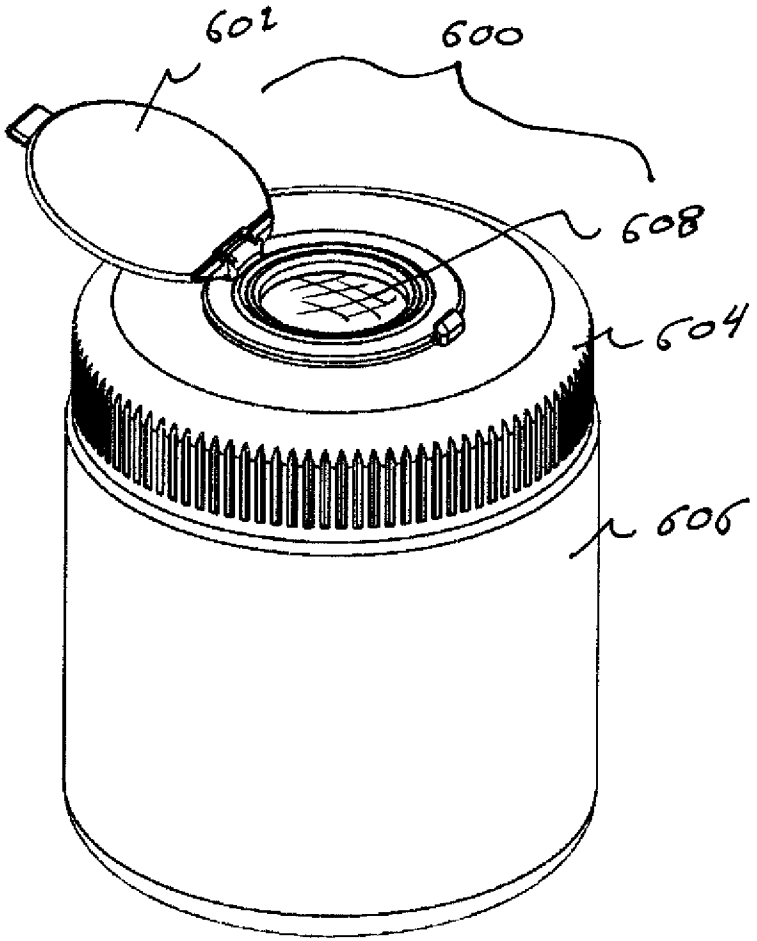
FIG. 26 is a perspective view of the second version of the embodiment mounted to a cap in the open position.

FIGS. 25 through 28 shows another version 600 of the third version of the invention except it is attached to the cap 604 of a bottle 606 rather than a pouch 518. Protective lid 602 is hinged to bottle cap 604. When the protective cap 602 is lifted as shown in FIG. 26, a filter disc 608 is shown which allows the user to smell the contents of the bottle 606 without needing to open the main bottle cap 604. This allows the bottle to retain its tamper proof status until opened after purchase.

Figure 27:
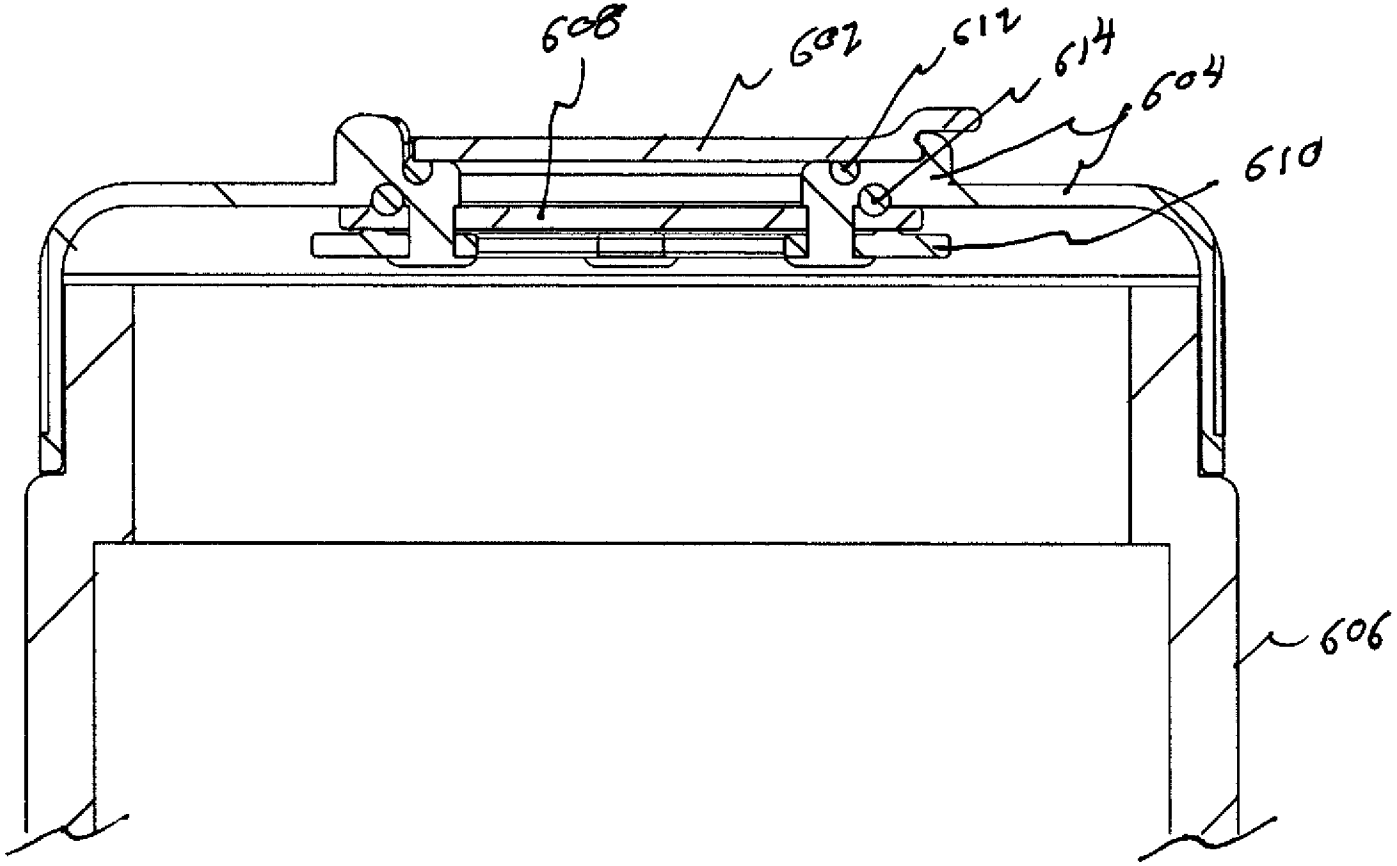
FIG. 27 is a side section view of the second version of the embodiment mounted to a cap.

FIG. 27 is a side section view of the third version of the embodiment 600. Gaskets 612 and 614 produce an airtight seal for protective lid 602 so that the bottle cap 604 and bottle 606 remains airtight after the protective lid 602 is closed after the user has smelled the contents of the bottle 606.

Figure 28:
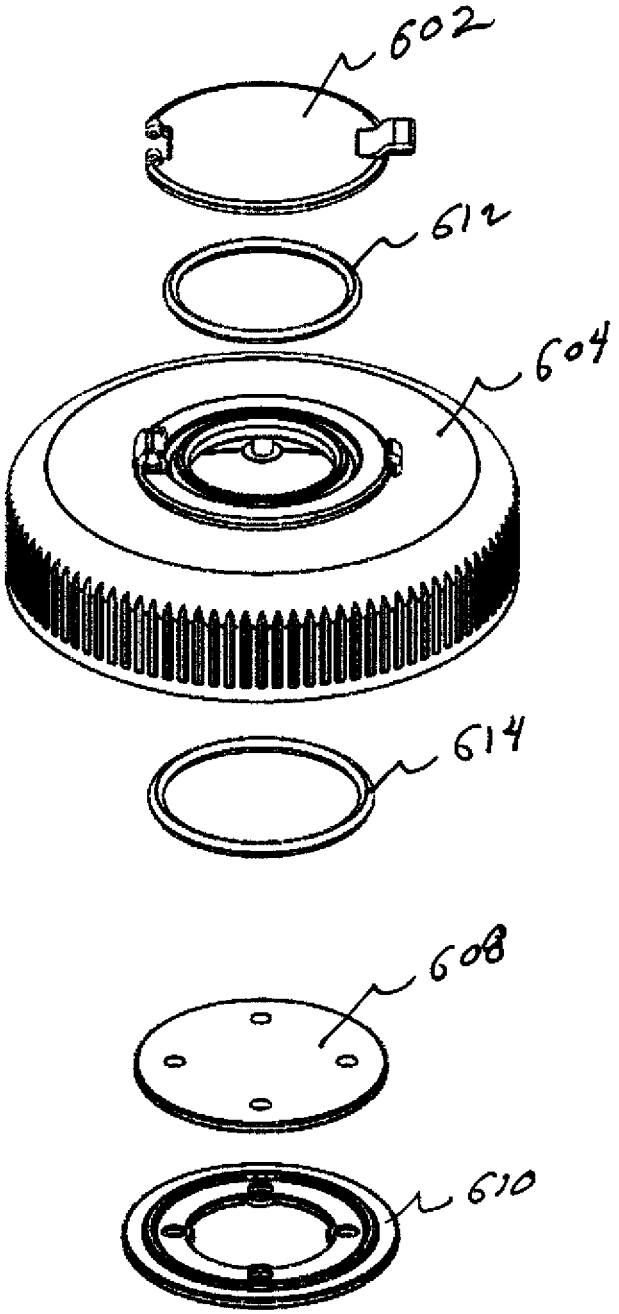
FIG. 28 is an exploded view of the second version of the embodiment mounted to a cap.

FIG. 28 is an exploded view of the third version of the embodiment 600 showing all components of the embodiment 600 in descending order.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

In the claims, the word 'comprising' does not exclude the presence of other elements or steps then those listed in a claim. Furthermore, the terms "a" or "an," as used herein, are defined as "one, or more than one." Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are arbitrarily used to distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

As used throughout this application, the word "may" is used in a permissive sense (i.e., meaning having the potential to), rather than the mandatory sense (i.e., meaning must). Similarly, the words "include," "including," and "includes" mean "including, but not limited to" the listed item(s).

What is claimed is:

1. An airtight container passageway aperture closure device with a container contents aroma detection access configured to keep the container contents secure from ingress of extraneous contamination, comprising:

(a) a cap airtightly mountable to the airtight container passageway aperture;

(b) the cap further comprising a recessed portion, wherein the recessed portion comprises a disc, a gasket and a shaft, wherein furthermore the disc, the gasket and the shaft being configured to be recessed within the container passageway;

(c) a resilient button comprising a plurality of apertures, wherein the apertures are small enough to minimize extraneous liquid or particles being able to penetrate through the plurality apertures of the resilient button; and (d) a protective cover, wherein the protective cover is substantially flush with the cap.

2. The airtight container access closure device of claim 1, wherein the resilient button is dome shaped.

3. The airtight container access closure device of claim 1, wherein the airtight container is at least one of a bottle, a pouch, or a jar.

4. A method of detecting aroma of an airtight container while keeping the container contents secure from ingress of extraneous contamination, comprising:

(a) providing a cap airtightly mountable to the airtight container passageway aperture, the cap further comprising a recessed portion, wherein the recessed portion comprises a disc, a gasket and a shaft, wherein furthermore the disc, the gasket and the shaft being configured to be recessed within the container passageway, the cap further comprising a resilient button comprising a plurality of apertures, wherein the apertures are small enough to minimize extraneous liquid or particles being able to penetrate through the plurality apertures of the resilient button, and a protective cover, wherein the protective cover is substantially flush with the cap;

(b) opening the protective cover;

(c) pressing the resilient button down causing the shaft to push down the disc allowing aroma of the container contents to emanate through the plurality of the resilient button apertures enabling a person to sample the scent of the container contents removing the container closure device;

(d) pressing the resilient button down repeatedly causing air in the container to be substantially displaced from within the container; and (e) closing the protective cover.

* * * * *